United States Patent [19]

Imaseki

[11] Patent Number: 4,848,941

[45] Date of Patent: Jul. 18, 1989

[54] THERMAL PRINTER

[75] Inventor: Chiharu Imaseki, Osaka, Japan

[73] Assignee: Minolta Camera Kabushiki Kaisha, Osaka, Japan

[21] Appl. No.: 203,154

[22] Filed: Jun. 6, 1988

[30] Foreign Application Priority Data

Jun. 5, 1987 [JP] Japan ..... 62-141799

[51] Int. Cl.[4] ..... B41J 3/20

[52] U.S. Cl. ..... 400/120; 346/76 PH; 400/208; 400/616.1; 400/649; 400/690.4; 400/691

[58] Field of Search ..... 400/120, 636.1, 649, 400/690.4, 54, 208, 616.1, 691; 346/76 PH

[56] References Cited

U.S. PATENT DOCUMENTS

| | | | |
|---|---|---|---|
| 4,505,603 | 3/1985 | Yana | 400/120 |
| 4,518,271 | 5/1985 | Hirata | 400/636.1 |
| 4,562,444 | 12/1985 | Nagashima et al. | 400/120 X |
| 4,614,949 | 9/1986 | Hakkaku et al. | 346/76 PH |
| 4,625,218 | 11/1986 | Watanabe | 346/76 PH |
| 4,632,585 | 12/1986 | Oyamatsu et al. | 400/120 |
| 4,689,639 | 8/1987 | Kimura et al. | 346/76 PH |
| 4,722,624 | 2/1988 | Musso | 400/636.1 |
| 4,768,039 | 8/1988 | Akutagawa et al. | 400/120 |

FOREIGN PATENT DOCUMENTS

| | | | |
|---|---|---|---|
| 0206238 | 6/1986 | European Pat. Off. | 400/120 |
| 58-140272 | 8/1983 | Japan . | |
| 0155480 | 8/1985 | Japan | 400/636.1 |
| 0192668 | 10/1985 | Japan | 400/120 |

*Primary Examiner*—Edgar S. Burr
*Assistant Examiner*—Moshe I. Cohen
*Attorney, Agent, or Firm*—Wenderoth, Lind & Ponack

[57] ABSTRACT

A thermal printer has a paper feeder including a platen roller, and a casing including a separating roller, the paper feeder being attached to the casing to be openable and closable. In this printer, when the paper feeder is opened, the separating roller is driven in response to the opening operation, to be set to a retracted position that is clear of the platen roller. When the paper feeder is closed, the separating roller is driven in response to the closing operation, to be set to an operative position out of contact with the platen roller with a predetermined spacing therebetween extending axially of the platen roller.

17 Claims, 5 Drawing Sheets

THERMAL PRINTER

BACKGROUND OF THE INVENTION

1. Field of the Invention

The present invention relates to thermal printers having a separate paper feeder and printer casing, the paper feeder being attached to the casing to be openable and closable.

2. Description of the Prior Art

In this type of thermal printer, as disclosed in Japanese Patent Publication Kokai No. 58-140272, for example, a separating roller is pressed against a platen roller. In this thermal printer, an ink ribbon may become creased for the following reasons:

(1) When patterns to be transferred vary to a great extent transversely of the ink ribbon, creases are formed on the ink ribbon during transportation thereof from a transfer position to a separating position since ink fixation and deformation of the ink ribbon due to the heat are not uniform transversely of the ink ribbon.

(2) When the platen roller and the separating roller are not parallel, creases are formed during transportation of the ink ribbon from the transfer position to the separating position during printing on an elongate sheet such as an A3 size sheet.

In the known printer in which the separating roller and the platen roller are in pressure contact, the creased ink ribbon is transported to the separating roller. Consequently, the ink ribbon having the creases advances to the transfer position to the detriment of the transfer operation.

In order to solve this problem it is conceivable to maintain the separating roller out of contact with the platen roller. However, the two rollers cannot be spaced wide apart due to characteristics of the ink employed. This results in the problem of interference between the platen roller and the separating roller occurring when the paper feeder is opened for changing the ink ribbon cassette, for example.

SUMMARY OF THE INVENTION

The primary object of the present invention, therefore, is to provide an improved thermal printer in which interference between the separating roller and the platen roller is obviated when the paper feeder is opened.

This object is achieved, according to the present invention, by a thermal printer comprising a first unit including the platen roller and a paper feeder; a second unit including the thermal head, an ink film feed mechanism, the separating roller, and support means for supporting the separating roller in an operative position and an inoperative position, the second unit supporting the first unit so as to be openable and closable; and an interlocking mechanism for moving the separating roller to the inoperative position in response to the opening of the first unit.

The above object is also achieved by a thermal printer comprising a first unit including at least the platen roller; a second unit including at least the separating roller, the separating roller being movable between an operative position and an inoperative position; an opening and closing mechanism for retaining the first unit and the second unit to be openable relative to each other; and an interlocking mechanism for moving the separating roller from the operative position to the inoperative position in response to the opening of the first and second units relative to each other.

According to the present invention, the separating roller is movable to a retracted position, at which it does not interfere with the platen roller, in response to the opening of the paper feeder. When the paper feeder is closed, the separating roller is set to an operative position. Since the separating roller is movable to the retracted position when the paper feeder is opened and to the operative position when the paper feeder is closed, a relatively long distance may be provided between the separating position and the transfer position, which contributes toward improved image quality.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings.

DETAILED DESCRIPTION OF THE PREFERRED EMBODIMENTS

Figure 1:
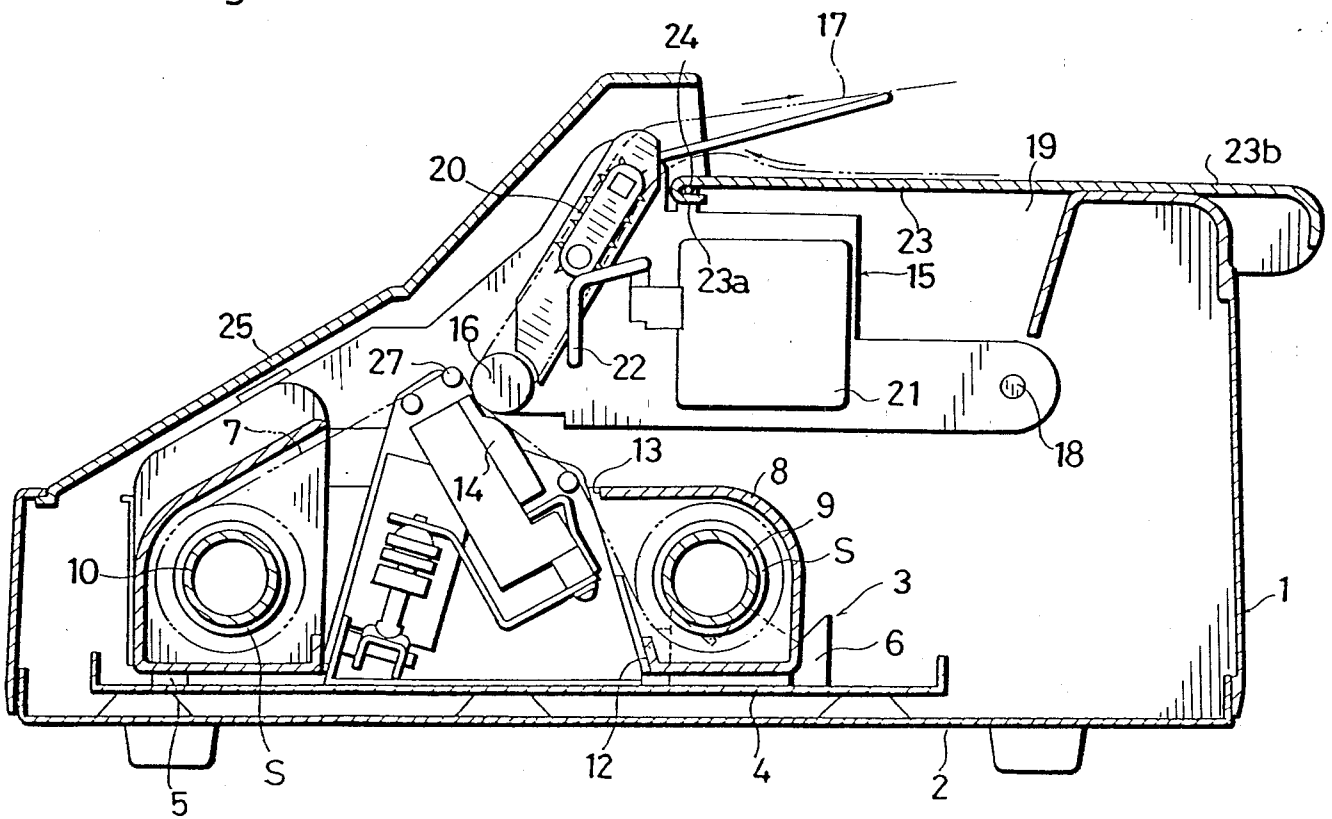
FIG. 1 is a sectional view showing the interior structure of a thermal printer embodying the present invention.

Referring to FIG. 1, a thermal printer according to the present invention comprises a casing 1 including a bottom plate 2 supporting a cassette mount 3. The cassette mount 3 includes a base 4, a polyurethane member 5 and a rear position setting block 6 for removably securing an ink ribbon cassette 8 containing an ink ribbon 7 in the printer.

The ink ribbon cassette 8 is formed of a plastic material and supports a supply roll 9 and a take up roll 10 with play S at rear and front portions thereof, respectively. The ink ribbon 7 is wound around the supply roll 9, and has a leading end thereof connected to the take up roll 10 with adhesive tape (not shown). Thus, thermal transfer of ink from the ink ribbon 7 occurs at a position between the two rolls 9 and 10. To allow the thermal transfer, the ink ribbon cassette 8 has a bottom plate and a top plate defining windows 12 and 13, respectively. A thermal head 14 extends through the windows 12 and 13 of the bottom and top plates of the ink ribbon cassette 8 mounted between the polyurethane member 5 and the block 6 on the base 4 of the cassette mount 3.

The thermal head 14 urges the ink ribbon 7 in the cassette 8 upward at the position between the two rolls 9 and 10, and presses the ink ribbon 7 against a platen roller 16 of a paper feeder 15 provided in an upper portion of the casing 1. At the area of pressure contact, the thermal head 14 effects the thermal transfer of ink from the ink ribbon 7 to recording paper 17. After the thermal transfer is effected, the recording paper 17 is advanced in tight contact with the ink ribbon 7 to a separating roller 27 where the ink ribbon 7 and the recording paper 17 are separated from each other.

Figure 2:
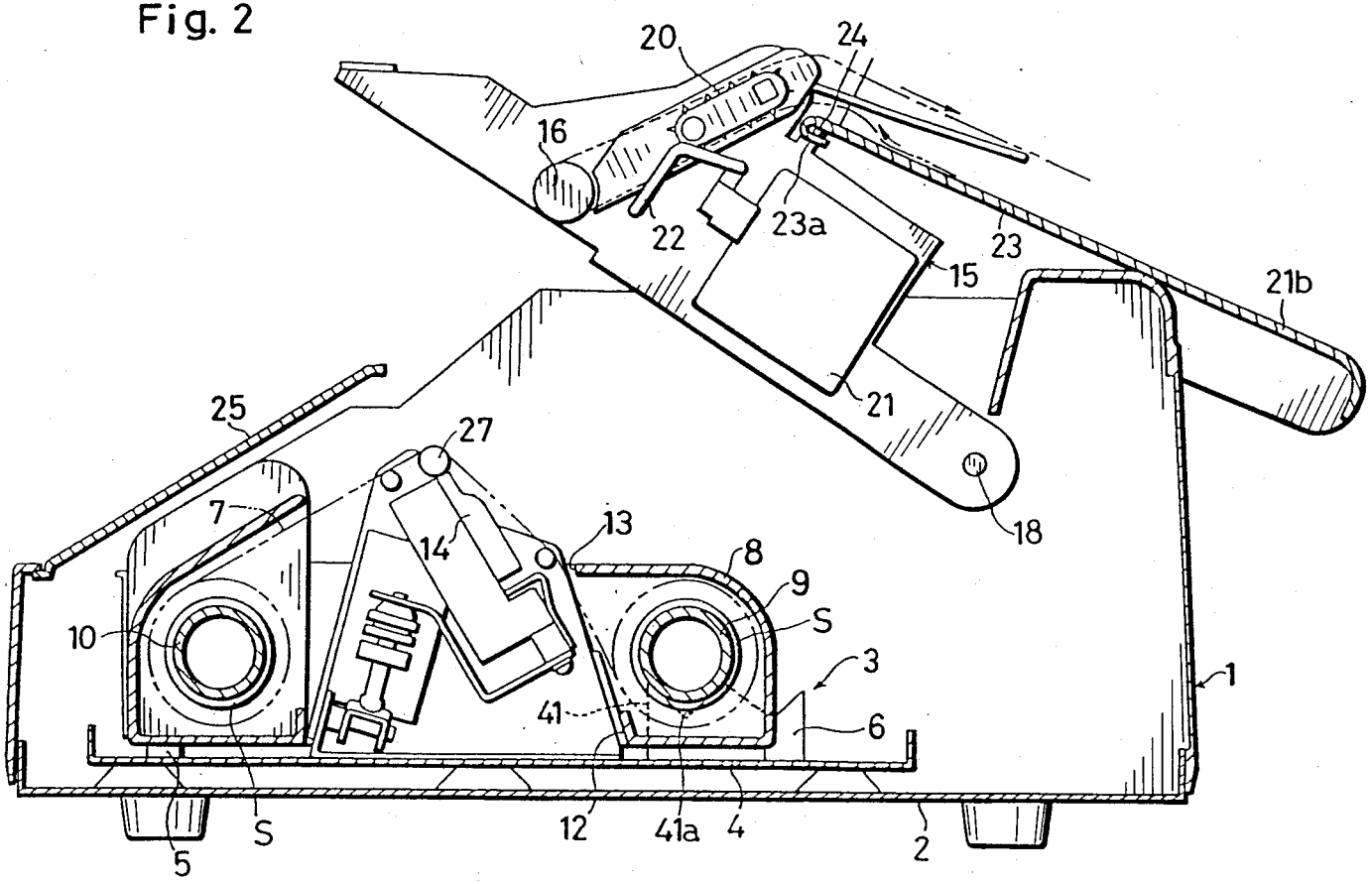
FIG. 2 is a sectional view similar to FIG. 1, with a paper feeder raised to a retracted position.

The paper feeder 15 is pivotable about a rear hinge pin 18 between an operative position as shown in FIG. 1 and a retracted position located upwardly and away from the cassette mount 3 as shown in FIG. 2. The casing 1 defines a top opening 19 to prevent interference with the upward pivotal movement of the paper feeder 15. The paper feeder 15 when in the retracted position allows easy access to the inside of the printer for attaching and detaching the ink ribbon cassette 8. The paper feeder 15 includes tractor feeders 20 above the platen roller 16, which are driven synchronously with the platen roller 16 to feed the recording paper 17 to the platen roller 16 and to move it away from the platen roller 16 as shown by arrows in FIG. 1. Numeral 21 indicates a drive motor of the paper feeder 15, and numeral 22 indicates a paper position sensor. A paper guide plate 23 is mounted on the paper feeder 15. The guide plate 23 has a bent front end **23*a* removably hooked on a pin 24 of the paper feeder 15, and a rear portion 23*b* resting on a top rear portion of the casing 1. The guide plate 23 is pivotable about the pin 24 to move under the pivotal movement of the paper feeder 15**, and is also detachable.

A removable front cover 25 is mounted on the casing 1 forwardly of the paper feeder 15. The cassette mount 3 is entirely exposed by removing the front cover 25 and swinging the paper feeder 15 to the retracted position, to allow the ink ribbon cassette 8 to be attached and detached with ease.

Figure 3:
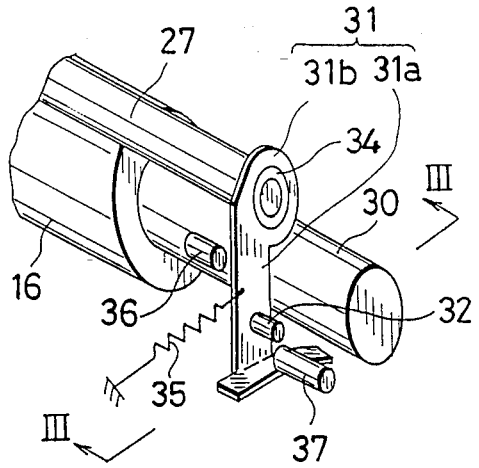
FIG. 3 is a perspective view of a portion of a platen roller and a separating roller with the paper feeder at an operative position.
Figure 4:
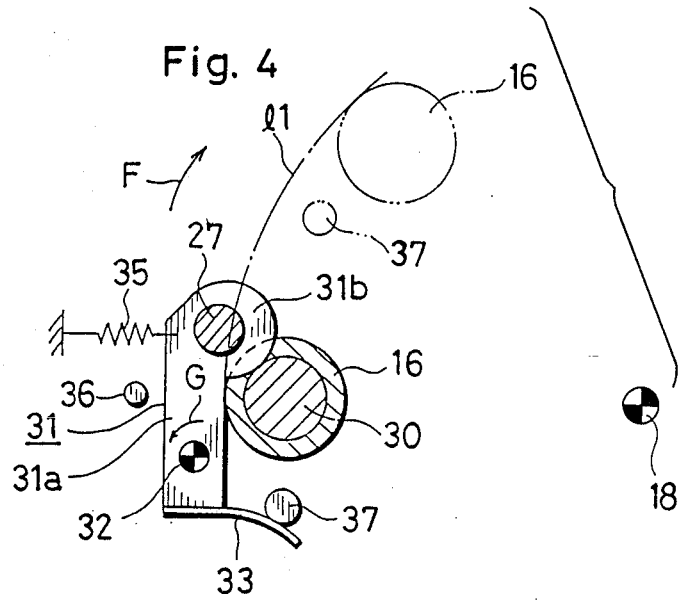
FIG. 4 is a sectional view taken along line III—III of FIG. 3.

FIG. 3 is a perspective view of a portion of the printer including the platen roller 16 and separating roller 27. FIG. 4 is a sectional view taken along line III—III of FIG. 3. A movable member 31 is shown opposite to a core 30 of the platen roller 16. The movable member 31 is pivotable about axis 32. The movable member 31 includes a main body **31*a*, and a contact portion 31*b* for contacting the peripheral surface of the core 30. A leaf spring 33 is secured to a lower portion of the main body 31*a*. The contact portion 31*b* contains a bearing 34 for supporting the separating roller 27. The contact portion 31*b* has a larger diameter than the separating roller 27. Consequently, when the contact portion 31*b* contacts the core 30, a space is defined between the separating roller 27 and the platen roller 16 extending in the direction of the axes thereof. An end of a coil spring 35 is connected to the movable member 31, the other end of the coil spring 35 being connected to the casing 1. Thus the movable member 31 is spring-loaded by spring 35 away from the core 30. Adjacent the side of the movable member 31 facing away from the core 30 is a stopper 36 for limiting angular displacement of the movable member 31 away from the core 30. A pressing pin 37 is disposed below the core 30 for pressing the leaf spring downwardly in FIG. 4 when the paper feeder 15** is lowered to the operative position.

The core 30, movable member 31, leaf spring 33, coil spring 35, stopper 36 and pressing pin 37 are provided at each pair of opposite ends of the platen roller 16 and separating roller 27. The movable member 31 and stopper 36 are attached to the casing 1, and the pressing pin 37 is attached to the paper feeder 15. Thus the pressing pin 37 is angularly displaced with the platen roller 16 about the pin 18 when the paper feeder 15 is swung between the operative position and the retracted position.

As shown in FIG. 4, the pressing pin 37 presses the leaf spring 33 downwardly when the paper feeder 15 is lowered to the operative position. As a result, the contact portion **31*b* of the movable member 31 is pressed against the core 30 against the urging force of coil spring 35. The separating roller 27 is set to an operative position out of contact with the platen roller 16 with the space extending axially of the platen roller 16. The separating roller 27 is attached to the movable members 31 at the opposite ends thereof through ball bearings with a slight amount of play. Therefore, when the two movable members 31 contact the core 30 under pressure, the separating roller 27 always extends parallel to the platen roller 16** without any displacement.

Figure 5:
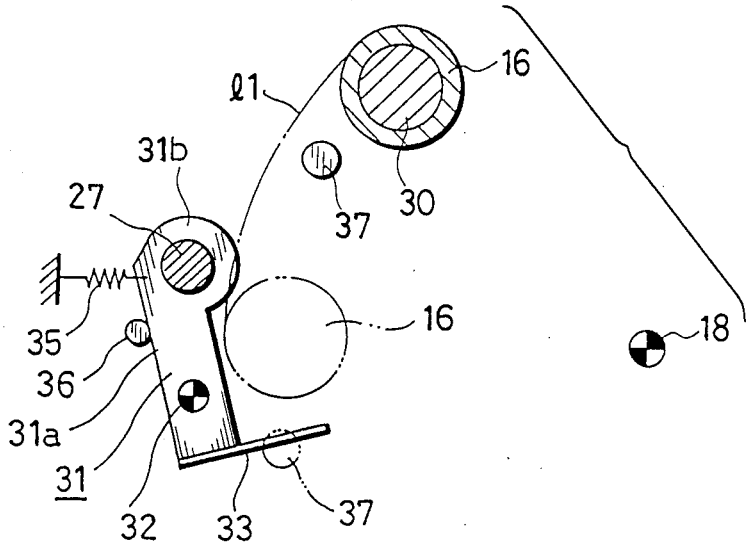
FIG. 5 is a sectional view of the platen roller and the separating roller with the paper feeder raised to the retracted position.
Figure 6:
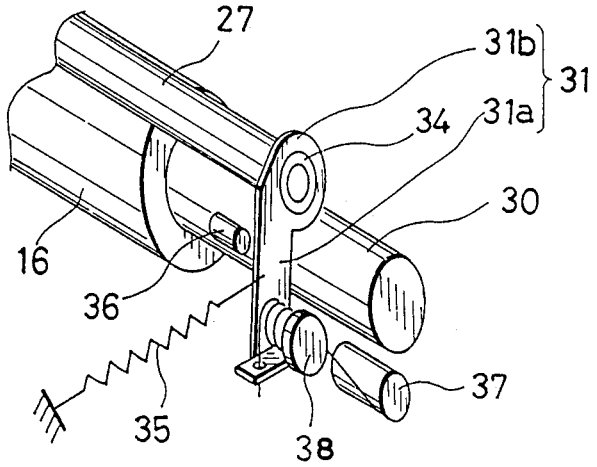
FIG. 6 is a perspective view of a portion of the printer according to another embodiment of the present invention.

The pressing force exerted by pressing pin 37 is retrieved when the paper feeder 15 is raised to undergo angular displacement about the pin 18 in the direction of arrow F for facilitating the changing of the ink ribbon cassette 8, for example. As a result, the movable member 31 is allowed to undergo angular displacement, about axis 32 under the urging force of coil spring 35, from the position shown in FIG. 4 in the direction of arrow G to the position contacting the stopper 36 as shown in FIG. 5. Thus the separating roller 27 is retracted outwardly of a line of travel l1 of the platen roller 16. Consequently, the paper feeder 15 is smoothly raised to the retracted position without the separating roller 27 interfering with the movement of platen roller 16.

When the paper feeder 15 is lowered, the pressing pin 37 presses the leaf spring 33 downward. As a result, the movable member 31 undergoes angular displacement in the direction opposite to the direction of arrow G from the position shown in FIG. 5 to the position shown in FIG. 4, to fix the separating roller 27 at the operative position. Since the separating roller 27 is placed in the retracted position by the action of the coil spring 35 when the paper feeder 15 is being lowered, there is no interference between the separating roller 27 and the platen roller 16.

As the thermal head 14 carries out a transfer operation in the state shown in FIG. 4, the recording paper 17 and ink ribbon 7 are transported to the separating roller 27 in tight contact with each other. The ink ribbon 7 and recording paper 17 are separated when passing over the separating roller 27. Since the separating roller 27 and the platen roller 16 are out of contact with each other, any creases formed on the ink ribbon 7 at the time of transfer are eliminated during the transportation thereof from the transfer position to the separating position. Furthermore, since the space between the separating roller 27 and the platen roller 16 is constant in the axial direction, the ink ribbon 7 is never transported at an angle and hence no creases will be developed.

The separating roller 27 is set to the retracted position with the upward movement of paper feeder 15 and to the operative position with the downward movement thereof. This operational relationship permits the separating roller 27 to be moved by a greater distance to the transfer position than in the prior art. The recording paper 17 is therefore separated from the ink ribbon 7 after the ink transferred onto the recording paper 17 has been fixed thereto completely, which contributes to excellent dot pattern reproduction. Even when the entire thermal head 14 becomes hot as a result of successive printing on a large number of sheets, there is little possibility of back transfer of the ink from the recording paper 17 to the ink ribbon 7. Thus the construction according to the present invention provides improved image quality as well.

The leaf spring 33 may be replaced with a torsion spring is secured at one end thereof to the movable member 31 and is pressed at the other end by the pressing pin 37.

Figure 7:
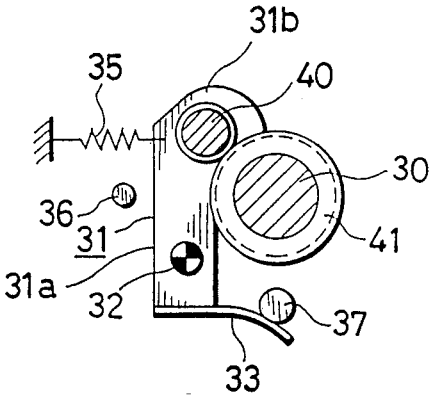
FIG. 7 is a sectional view of another embodiment.

FIG. 7 shows a further embodiment which is similar to the foregoing embodiments, wherein like parts are labeled with like reference numerals. The notable feature of this embodiment lies in rotatable elements 40 and 41 mounted on the separating roller 27 and on the core 30 of the platen roller 16, respectively. The rotatable elements 40 and 41 comprise bearings, for example. In the previously described embodiment having the core 30 contactable by the contact portion **31*b* of the movable member 31 under pressure, the rotation of platen roller 16 is somewhat impaired. The rotatable elements 40 and 41 as used in this embodiment are effective to eliminate such a drawback. A satisfactory result may also be obtained by using only one of the rotatable elements 40 and 41**.

Figure 8:
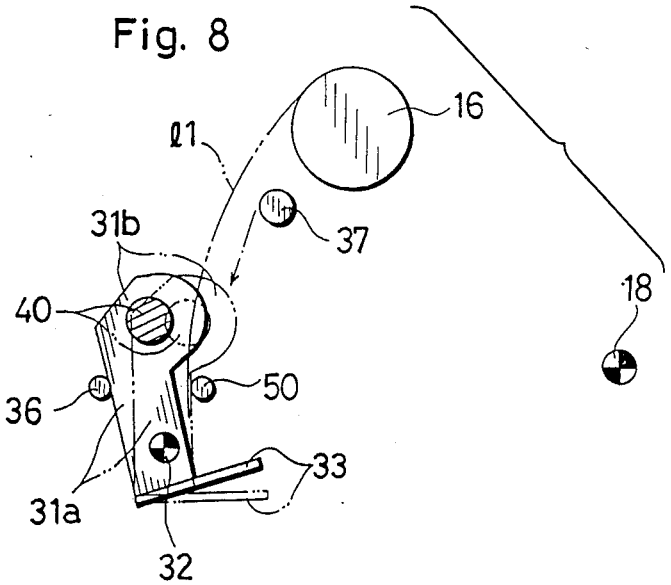
FIG. 8 is a sectional view of still another embodiment.

FIG. 8 shows still another embodiment similar to the foregoing embodiment, with like parts labeled with like numerals. The notable feature of this embodiment is the omission of the coil spring 35. When the paper feeder 15 is lowered, the pressing pin 37 presses on the leaf spring 33. As a result, the movable member 31 is angularly displaced clockwise to the operative position of the separating roller 27 shown in a phantom lines in FIG. 8. In this operative position the movable member 31 is in contact with a stopper 50 to be set in position accurately.

When the paper feeder 15 is raised, the core 30 pushes the contact portion **31*b* and causes the movable member 31 to undergo a slight amount of anglular displacement in the counterclockwise direction. Thereafter, the movable member 31 undergoes further angular displacement under gravity to move into contact with the stopper 36, whereby the separating roller 27 reaches the retracted position. Thus, the coil spring 35 may be dispensed with by using the weight of movable member 31 to retract the separating roller 27**.

An inadvertent touch of movable member 31 by a hand may move the movable member 31 to the operative position shown in the phantom lines in FIG. 8 while the paper feeder 15 is in the upper, retracted position. When the paper feeder 15 is lowered in this state, the pressing pin 37 pushes the contact portion **31*b* of movable member 31. As a result, the movable member 31 slightly undergoes counterclockwise angular displacement which is followed by the displacement thereof under gravity, and stops at the stopper 36. In this way, the separating roller 27 may be moved from the operative position to the retracted position by the descending paper feeder 15 before the separating roller 27 interferes with the platen roller 16**.

As an example of a further modification, a bistable spring may be provided for the movable member 31 to place the latter in two stable positions. While in the described embodiment the movable member 31 is angularly dispaceable about the axis 32, the movable member 31 may be adapted for linear reciprocation by which the separating roller 27 is moved between the operative position and the retracted position. The movable member 31 has been described as including the contact portion **31*b*, but alternatively the core 30** may define a contact member for contacting the peripheral surface of the separating member.

Although the present invention has been fully described by way of examples with reference to the accompanying drawings, it is to be noted that various changes and modifications will be apparent to those skilled in the art. Therefore, unless such changes and modifications otherwise depart from the scope of the present invention, they should be construed as being included therein.

What is claimed is:

1. A thermal printer for feeding an ink ribbon and recording paper in tight contact with each other between a thermal head and a platen roller, driving the thermal head to transfer ink of the ink ribbon onto the recording paper, and thereafter separating the ink ribbon and the recording paper with a separating roller, said thermal printer comprising:

a first unit including said platen roller and a paper feeder;

a second unit including said thermal head, an ink ribbon feed mechanism, said separating roller, and support means for supporting said separating roller in an operative position and an inoperative position, said second unit supporting said first unit so as to be openable and closable thereon; and an interlocking mechanism for moving said separating roller to the inoperative position in response to the opening of said first unit.

2. A thermal printer as claimed in claim 1, wherein said first unit further includes a pressing pin disposed adjacent said platen roller for contacting said support means to set said separating roller to said operative position when said first unit is closed.

3. A thermal printer as claimed in claim 1, wherein said support means includes means for setting said separating roller to said operative position such that said separating roller is maintained out of contact with said platen roller with a constant spacing therebetween extending axially of said platen roller.

4. A thermal printer as claimed in claim 1, wherein said support means comprises a pair of movable members pivotable about an axis adjacent said platen roller, said separating roller extending between and supported by said pair of movable members.

5. A thermal printer as claimed in claim 4, wherein said platen roller has a core, and each of said movable members includes a contact portion for contacting a peripheral surface of the core of said platen roller, said contact portion having a diameter that is larger than the diameter of said separating roller.

6. A thermal printer as claimed in claim 5, wherein at least one of said separating roller and said platen roller has a rotatable element supported thereon.

7. A thermal printer as claimed in claim 1, wherein said second unit includes a casing, and said interlocking mechanism comprises a tension spring connected at one end thereof to said support means and at the other end thereof to the casing of said second unit.

8. A thermal printer as claimed in claim 1, wherein said support means comprises a movable member pivotable about a pivot axis that is spaced the same distance from the central axis of said separating roller when in the operative position and the central axis of said separating roller when in the inoperative position, said movable member being supported stably by said support means when at the operative position and the inoperative position.

9. A thermal printer as claimed in claim 8, wherein said movable member includes a spring piece disposed at a portion thereof that is opposite a portion supporting said separating roller with respect to said center point, and said first unit includes a pressing pin, said spring piece being pressed by said pressing pin of said first unit when said first unit is closed in a direction that urges said movable member toward said operative position.

10. A thermal printer as claimed in claim 8, wherein said platen roller has a core, and said movable member includes a contact portion for contacting a peripheral surface of the core of said platen roller, said contact portion being in slidable contact with the core of said platen roller when said first unit is being opened

11. A thermal printer for feeding an ink ribbon and recording paper in tight contact with each other between a thermal head and a platen roller to transfer ink of the ink ribbon onto the recording paper, and thereafter separating the ink ribbon and the recording paper by means of a separating roller, said thermal printer comprising:

a first unit including at least said platen roller;

a second unit including at least said separating roller, said separating roller being movable between an operative position and an inoperative position;

an opening and closing mechanism connected to said units for allowing said first unit and said second unit to be openable relative to each other; and an interlocking mechanism for moving said separating roller from the operative position to the inoperative position in response to the opening of said first and second units relative to each other.

12. A thermal printer as claimed in claim 11, wherein said second unit further includes support means for supporting said separating roller between the operative position and the inoperative position.

13. A thermal printer as claimed in claim 12, wherein said first unit further includes a pressing pin disposed adjacent said platen roller for contacting said support means to set said separating roller to said operative position when said first unit is closed.

14. A thermal printer as claimed in claim 12, wherein said support means includes means for setting said separating roller to said operative position such that said separating roller is maintained out of contact with said platen roller with a constant spacing therebetween extending axially of said platen roller.

15. A thermal printer as claimed in claim 12, wherein said support means comprises a pair of movable members pivotable about an axis adjacent said platen roller, said separating roller extending between and supported by said pair of movable members.

16. A thermal printer as claimed in claim 15, wherein said platen roller has a core, and each of said movable members includes a contact portion for contacting a peripheral surface of the core of said platen roller, said contact portion having a diameter that is larger than the diameter of said separating roller.

17. A thermal printer as claimed in claim 16, wherein at least one of said separating roller and said platen roller has a rotatable element supported thereon.

* * * * *